United States Patent [19]

Aarons

[11] 4,109,428

[45] Aug. 29, 1978

[54] ROOF EDGING

[75] Inventor: Raymond Joseph Aarons, Jindalee, Australia

[73] Assignee: Monier Colourtile Pty. Ltd., Darra, Australia

[21] Appl. No.: 840,479

[22] Filed: Oct. 6, 1977

Related U.S. Application Data

[63] Continuation-in-part of Ser. No. 687,702, May 19, 1976, abandoned.

[51] Int. Cl.[2] ..... E04B 7/06; E44D 3/40

[52] U.S. Cl. ..... 52/94; 52/95

[58] Field of Search ..... 52/94, 95

[56] References Cited

U.S. PATENT DOCUMENTS

| | | | |
|---|---|---|---|
| 3,135,070 | 6/1964 | Waring et al. | 52/94 |
| 3,242,622 | 3/1966 | Snead | 52/94 |
| 3,344,563 | 10/1967 | Mills et al. | 52/94 X |
| 3,543,456 | 12/1970 | Gregoire | 52/92 |
| 3,939,619 | 2/1976 | Mason | 52/509 |

FOREIGN PATENT DOCUMENTS

| | | | |
|---|---|---|---|
| 6,707,729 | 12/1967 | Netherlands | 52/94 |
| 1,347,974 | 2/1974 | United Kingdom | 52/94 |

*Primary Examiner*—Alfred C. Perham
*Attorney, Agent, or Firm*—Haseltine, Lake & Waters

[57] ABSTRACT

A roof edging for finishing gable ends of tiled roofs comprising edging strips having flanges which pass over the edge tiles and between the tiles and the tiling battens. Clips engage the inner contour of the edging strips and are fastened to the battens.

6 Claims, 7 Drawing Figures

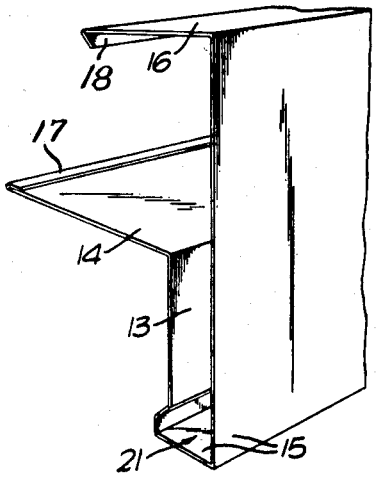
Fig. 2.
Fig. 3.
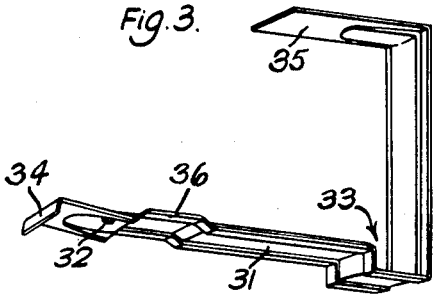
Fig. 4.
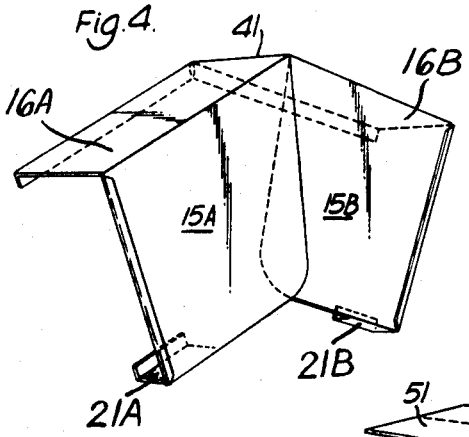
Fig. 5.
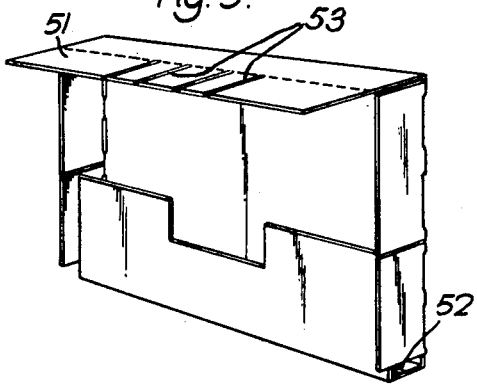

ROOF EDGING

CROSS-RELATED APPLICATION

This Application is a continuation-in-part of application Ser. No. 687,702 filed May 19, 1976 now abanboned.

FIELD OF THE INVENTION

This invention relates to a new and improved method of roof edging for finishing gable ends of tiled roofs and to various structures used in conjunction with that edging.

PRIOR ART

Traditionally, roofing tiles at the gable end are either bedded and pointed or covered with a purpose-made barge tile.

When bedding and pointing is the required finish for the gable end tiles, the tiler uses a mixture of sand and cement and adds a color, usually an organic pigment, which when dry matches closely the surface color of the tiles.

When a barge tile finish is specified, the tiler positions same along the gable end and beds and points, with a similar mixture to the foregoing, the barge tile to the surface of the roofing tile and screws the down leg of the barge tile to the supporting structure which may be a timber barge board.

In both the above instances, the construction of the roof to take either of these finishes is different and therefore if either method has not been carried out correctly during the construction program, extreme difficulties can occur during installation of the roof even to the extent of having to alter drastically the preparation for the finish so that the correct finish can be achieved ensuring the desired aesthetic appearance.

Both systems of finishing gable ends have a high degree of labor and material content as well as the skill necessary to ensure a satisfactory aesthetic appearance acceptable to all concerned.

In the case of the bedding and pointed finish there are both short and long term disavantages. Some of these are:

Poor adhesion between the bedding mixture and the surface to which it has been applied, causing hairline cracks to occur between the bedding mixture and the surface of the strip or barge board and as a consequence water will penetrate causing internal damage and even rotting of barge board and the timber.

Shrinkage and settlement of building structures will cause the cracked bedding and pointing to fall away from the roof thus creating not only an unsigtly apperance but a passage for water penetration under normal weather conditions. Lastly and by no means least the lack of security of the gable end tiles when fixed in this manner. This means that even under normal high winds tiles can be dislodged and cause damage to the balance of the roof covering as well as allow water penetration to internal linings.

The application of barge tiles to the gable ends requires considerable skill on the part of the tiler to ensure that each tile is properly bedded and lined with the run of the gable and firmly screwed to the roof structure. Aesthetically, barge tiles are bulky in appearance particularly on small gable runs such as short skillion roofs, verandahs etc. When a brick gable end is to be covered by a barge tile finish the degree of difficulty of screwing the barge tiles is even greater and requires considerable care and attention on the part of the roof tiler to ensure a satisfactory and secure finish.

SUMMARY OF THE INVENTION

The present invention has been devised with the general object of providing a simply installed roof edging which is maintenance free and includes security for the gable end tiles. It can be applied to most forms of roofing construction of varying shapes and types.

The roof edging of this invention allows for composite types of applications such as:

(i) Attachment on to a timber barge board previously supplied and fixed into position by a builder.

(ii) Use with a barge moulding which replaces the existing timber type barge board for use on flush gable ends of buildings which are sheeted in a variety of building materials including solid block or brick.

(iii) Use with a barge moulding which substitutes for the timber barge board to be fixed to gable roofs which have an overhanging soffit line gable end.

A further specific object of the invention is to provide such a roof edging in which the parts used are of standard dimensions irrespective of the thickness of tile battens, or the type of construction to which the edging is applied.

A further object of the invention is to provide an assembly of face plate and securing clips in which the clips may be mounted in the face plate and the combined assembly then attached by securing the clips to the building structure.

The invention accordingly comprises an edging strip assembly for tiled roofs including a normally vertical face plate; an upwardly-facing substantially rectangular channel formed between the lower part of said face plate and a vertical flange spaced therebehind; an upper tile-retaining flange extending rearwardly from the upper edge of said face plate to pass above the edge tiles; a lower tile-retaining flange extending rearwardly from the upper edge of said vertical flange to lie between said edge tiles and their tiling batten; spaced attachment clips each having a horizontal arm passing between said lower flange and said edge tiles and each clip engaging within said face plate and said upper flange; and fastening means for securing said horizontal arm to said tiling batten.

BRIEF DESCRIPTION OF THE DRAWINGS

An embodiment of the invention will be described by way of example with reference to the accompanying drawings, in which:

FIG. 2 is an isometric view of an edging strip of the assembly,

FIG. 3 is an isometric view of a clip for use, with the strip of FIG. 2, FIG. 4 shows a modified angularly-adjustable cover strip for use at a roof apex, FIG. 5 shows a stop-end for the edging strip of FIG. 2.

DETAILED DESCRIPTION OF THE PREFERRED EMBODIMENT OF THE INVENTION

Figure 1:
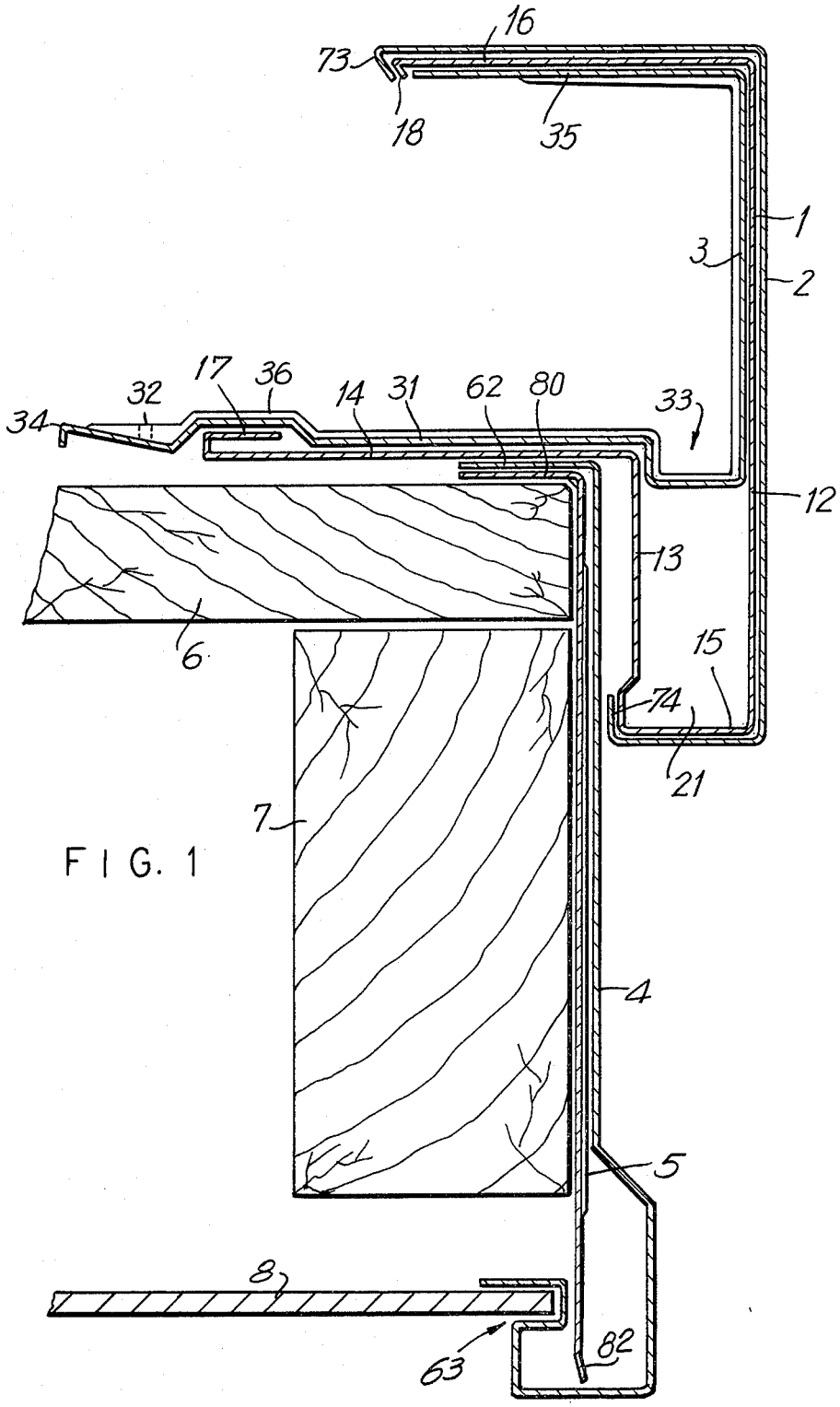
FIG. 1 shows in section an assembly for roof edging.

The assembly of FIG. 1 includes a roof edging strip 1, a cover strip 2 for use on butted lengths of strip 1, a holding clip 3 attaching the assembly to tiling battens 6, a barge-board 4 and a barge-board clip 5 attaching barge-board 4 to battens 6.

Strip 1 includes a normally vertical face plate 12, a rearward portion 15 and a vertical flange 13, thus forming an upwardly-facing substantially rectangular channel 21 between plate 12 and flange 13.

Strip 1 carries an upper flange 16 and a lower flange 14, flange 16 lying over edge tiles (not shown) and flange 14 lying between such edge tiles and tiling batten 6. Each clip 3 has a horizontal arm 31 secured at 32 to the batten 6 and passing between flange 14 and the edge tiles. Clip 3 is bent to a transverse channel form at 33 to fit within channel 21 and passes upwards and rearwards at 35 to fit within face plate 12 and upper flange 16, the end of arm 35 being retained by a downward return 18 on flange 16.

Cover strip 2 which covers successive butted lengths of edging strip 1, has a return 73 engaging over return 18 and an upward flange 74 engaging behind channel 21. Cover strip 2 allows endwise movement of adjacent lengths of edging strip 1 to take up expansion and contraction.

Barge board 4 lies between rafter 7 and flange 13 of strip 1 in the overhanging roof edge of FIG. 1 and has an upper flange 62 lying between lower flange 14 of strip 1 and batten 6. Suitable spaced clips 5 attached to batten 6 retain barge board 4 in position. The lower edge of barge board 4 has a rearwardly-facing slot 63 into which soffit sheeting 8 may be fitted. For flush-ended gables, the lower end of barge board 4 may be modified as shown at 61 in FIG. 6 to butt against the wall end, since no soffit is then included.

Lower flange 14 of strip 1 is bent over at 17 to form a bead to retard any water penetration into the roof space below. Clip 3 is raised at 36 to clear this bead. Any water penetrating clip 1 is also channelled away in channel 21.

Clip 3 has a downward flange 34 on the inner end of arm 31. Since attachment at 32 lies forward of flange 34, the clip is pressed firmly down into channel 21 on attachment, and urges arm 35 into firm engagement with return 18.

FIG. 5 shows a stop end which fits slidably within the end of an edging strip 1 to cover the end of channel 21 and the space above it between tile edges and face plate 12. Slots 53 enable sections of flange 51 to be bent down to provide a barrier to entry of birds or other vermin into the edging strip 1. The opening 52 enables any water in channel 21 of the edging strip to drain away.

FIG. 4 shows a modified cover strip for roof peaks or valleys.

Two separate face plate members 15A, 15B are angularly adjustable about line 41, and each carries a truncated lower flange 21A, 21B respectively, to fit around channel 21 of edge strips 1. Upper flanges 16A, 16B fit over upper flange 16 of strips 1. A cover strip is therefore provided for a roof peak, or by inverse bending on line 41, for a roof valley.

In assembling the roof edging, the lower flange 14 is located on top of the tiling battens 6 (or roof rafters 7) with clips 3 previously inserted into the strip 1 at regular intervals to coincide with the spacing of the battens 6.

The clips 3, and thus the whole assembly, is attached to the roof structure by nails driven through holes 32 and into the tiling battens.

Figure 7:
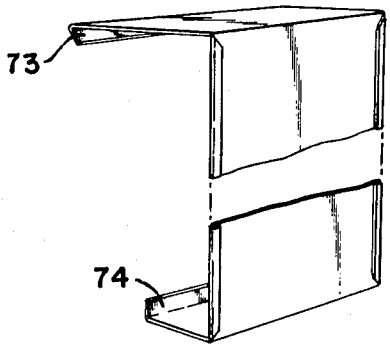
FIG. 7 shows a joining piece for butt-joining successive lengths of strip.

Butted ends of strips 1 are covered by cover strips 2 as shown in FIG. 7 or in FIG. 4 as required.

Stop ends (FIG. 5) are slid into place in the end strips 1.

Figure 6:
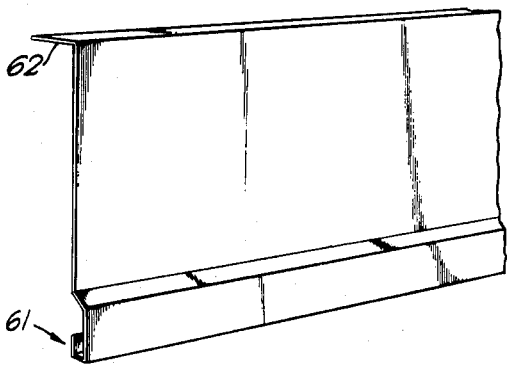
FIG. 6 shows a pre-fabricated barge board used in the assembly in FIG. 1

If a prefabricated barge mould as shown at 4 in FIG. 1 or in FIG. 6 is to be used, the barge mould is simply fixed in position by placing the lower lip of the barge mould under the bottom leg 82 of support clips 5 as in FIG. 1 and positioning the top flange 62 of the barge mould over the horizontal top 80 of the support clips previously fixed to the filing battens 6.

The lenghts of barge mould 4 are butted together until the whole of the gable end is covered from fascia to apex. The joins in the barge mould where applicable are covered by means of butt joiners (not shown) profiled to the barge mould and simply snapped into position over the outer face of the abutting barge mould lengths. The strip 1 is then applied over the top of the barge mould, in the manner previously explained.

As can be seen, installation is made during the provess of covering a roof with roof tiles. A major benefit liesin the fact that roofing can be completed in spite of threatening weather change which frequently causes a wash-out of mortar bedding and pointing, if such is the finish on the gable end thus requiring additional work and further cost to the end consumer.

The simplicity with which the assembly is made and the fact that no special skills and tools are required ensures a satisfactory appearance and above all the security of the tiles in the area of the roof which is predominately the section that suffers most under extreme wind conditions.

A particular feature of this assembly is that (as previously described) the clips 3 are pre-engaged in strip 1 and the whole assembly attached, with much less trouble than the separate attachment of clips and later engagement of an edging strip.

What is claimed is:

1. An edging strip assembly for tiled roofs comprising: a normally vertical face plate having a lower part and a vertical flange spaced therefrom, an upwardly-facing substantially rectangular channel formed between said lower part of said face plate and said vertical flange;

an upper tile-retaining flange extending rearwardly from an upper edge of said face plate to pass above edge tiles;

a lower tile-retaining flange extending rearwardly from an upper edge of said vertical flange to lie between said edge tiles and their tiling batten;

spaced attachment clips each including a horizontal arm passing between said lower flange and said edge tiles and each clip being pre-engaged within said face plate and said upper flange and assembled as a unit with said face plate;

and fastening means for securing said horizontal arm to the tiling batten.

2. An assembly as claimed in claim 1, in which each clip has an upwardly-facing transverse channel fitting within said rectangular channel, and upward and rearward arms contracting said face plate and said upper flange respectively.

3. An assembly as claimed in claim 1, further including a prefabricated barge-board secured to the building structure and lying in part behind said vertical flange.

4. An assembly as claimed in claim 3, in which said barge-board is provided with a rearwardly-facing longitudinal slot to accommodate the edge of a soffit.

5. An assembly as claimed in claim 1, which said lower flange includes a bead at its rear edge and said horizontal arm has a raised portion to clear said bead.

6. An assembly as claimed in claim 5, in which the inner end of said horizontal arm includes a downward flange bearing on the tiling batten, said fastening means being forward of said downward flange.

* * * * *